US008085207B2

(12) United States Patent
Miller et al.

(10) Patent No.: US 8,085,207 B2
(45) Date of Patent: Dec. 27, 2011

(54) ANTENNA GUARD

(75) Inventors: Jason Lee Miller, Peoria, IL (US); Kevin M. Sergeant, Newnan, GA (US)

(73) Assignee: Caterpillar Forest Products Inc., Peoria, IL (US)

( * ) Notice: Subject to any disclaimer, the term of this patent is extended or adjusted under 35 U.S.C. 154(b) by 728 days.

(21) Appl. No.: 12/186,355

(22) Filed: Aug. 5, 2008

(65) Prior Publication Data

US 2010/0033388 A1 Feb. 11, 2010

(51) Int. Cl.
*H01Q 1/32* (2006.01)

(52) U.S. Cl. ..... 343/711; 343/713; 343/715

(58) Field of Classification Search ..... None
See application file for complete search history.

(56) References Cited

U.S. PATENT DOCUMENTS

| | | | | |
|---|---|---|---|---|
| 2,748,905 | A | 6/1956 | Avruch | |
| 3,442,476 | A | 5/1969 | Trimble | |
| 4,134,121 | A * | 1/1979 | Northcutt | 343/715 |
| 4,218,684 | A | 8/1980 | Northcutt | |
| 4,377,812 | A | 3/1983 | Göbel et al. | |
| 4,513,338 | A | 4/1985 | Goodall | |
| 6,331,838 | B1 * | 12/2001 | Scott et al. | 343/715 |
| 7,218,284 | B2 * | 5/2007 | Aizawa et al. | 343/713 |
| 7,271,773 | B2 * | 9/2007 | Gorai et al. | 343/711 |
| 2003/0076270 | A1 * | 4/2003 | Okamoto | 343/713 |

FOREIGN PATENT DOCUMENTS

FR 2 844 639 * 3/2004

* cited by examiner

*Primary Examiner* — Trinh Dinh

(57) ABSTRACT

A guard (120) for an antenna (602) includes a base (206) defined between a front edge (209), a rear edge (211), and two lateral edges (213, 215). A front generally triangular surface (208) extends from the front edge (209) to a narrowed upper edge, a rear generally triangular surface (210) extends from the rear edge (211) to a narrowed upper edge, and two lateral generally triangular surfaces (212, 214), each having a narrowed upper edge, extend from their respective lateral edge (213, 215). The narrowed upper edges form an apex (204), which forms an opening (202). The surfaces (208, 210, 212, 214) at least partially define an internal cavity (304) that encloses a portion (604) of the antenna (602). The front surface (208) is at a first angle (α) relative to a mounting surface (117) and the rear surface (210) is at a second, larger angle (β) relative to the mounting surface (117).

15 Claims, 6 Drawing Sheets

ANTENNA GUARD

TECHNICAL FIELD

This patent disclosure relates generally to protective devices for preventing damage to aerial antennas on vehicles and, more particularly, to guards that protect the antennas by deflecting foliage or other debris away from a base of the antenna.

BACKGROUND

Aerial antennas on vehicles are used to perform various functions. High-density antennas have been used in applications requiring transmission and receipt of shortwave or high frequency signals, such as, for example, shortwave, radio, or radio-based global positioning system (GPS) applications. Such signals require antennas that include more than one conductor extending parallel to one another along the aerial portion of the antenna. The conductors in such antennas are typically bunched together along a main body or shaft of the antenna, and are covered in a flexible material that can conduct signals, such as rubber, for protection from corrosion.

In some applications, machines may operate in locations where the antenna may encounter objects from the environment of the machine, for example, tree branches, which may damage the antenna. Past attempts to mitigate the effects of such environmental issues have included shortening the length of the antenna, positioning the antenna in a location of the machine that is not prone to damage from surrounding objects, or bending the antenna such that it does not protrude from the machine. These and other measures, however, are not completely effective because they tend to reduce the sensitivity of the antenna and, thus, the functional range of the machine.

SUMMARY

The disclosure describes, in one aspect, a guard for an antenna. The guard includes a base defined between a front edge, a rear edge, and two lateral edges. A front generally triangular surface extends from the front edge to a narrowed upper edge and a rear generally triangular surface extends from the rear edge to a narrowed upper edge. Two lateral generally triangular surfaces, each having a narrowed upper edge, extend from their respective lateral edge to complete the guard. The narrowed upper edges form an apex, which forms an opening. The surfaces at least partially define an internal cavity that encloses a portion of the antenna. The front surface is at a first angle relative to a mounting surface, and the rear surface is at a second, larger angle relative to the mounting surface.

In another aspect, the disclosure describes a guard for use with an antenna installed on a mounting surface of a machine. The antenna includes an antenna mount connected to the mounting surface and an aerial portion connected to the antenna mount and extending away from the mounting surface. The guard includes a skewed pyramidal shape having a base having a base opening therethrough, and an upper body. The upper body has at least a front surface and a rear surface extending from the base. The front surface is disposed at a shallower grade than the rear surface and is adapted to face the direction of travel of the machine. The upper body defines an upper opening, with the aerial portion extending through the upper opening and the antenna mount extending through the base opening.

In yet another aspect, this disclosure provides a machine. The machine includes a mounting surface. An antenna assembly having an antenna mount and an aerial portion is coupled to the mounting surface, and a guard is coupled to the machine. The guard has a substantially pyramidal shape that includes a base, an apex, a front face, a rear face, and two lateral faces extending between the base and the apex. The apex forms an upper opening and the guard forms a cavity. The cavity opens through the base and communicates with the upper opening. The antenna mount is disposed in the cavity, and the aerial portion extends at least partially within the cavity and at least partially outside of the guard, passing through the upper opening.

DETAILED DESCRIPTION

This disclosure relates to guards for aerial and other antennas that are attached to a machine and that are positioned in locations of the machine that are prone to contact with or intrusion by foliage or other debris during machine operation. The embodiments for a guard in accordance with the disclosure are especially useful in that they provide protection against damage of the antenna without a reduction of signal strength. In one embodiment, a guard is disclosed that is arranged to protect an aerial antenna from damage by deflecting objects passing over a base of the antenna. The guard, in one embodiment, encloses a non-aerial or satellite antenna used in conjunction with a GPS system. A wheel skidder is used in the description that follows as one example of a machine that typically operates in an environment where branches or other foliage are present.

The guard disclosed herein has universal applicability in other types of machines as well. The term "machine" may refer to any machine that performs any type of operation associated with an industry such as mining, forestry, construction, farming, transportation, or any other industry known in the art. For example, the machine may be an earth-moving machine, such as a wheel loader, excavator, dump truck, backhoe, motorgrader, material handler or the like. Further, the machine may be a forestry machine, such as a log forwarder, wheel or track skidder or the like. Moreover, an implement may be connected to the machine. Such implements may be utilized for a variety of tasks, including, for example, loading, compacting, lifting, brushing, and include, for example, buckets, compactors, forked lifting devices, brushes, grapples, cutters, shears, blades, breakers/hammers, augers, and others.

Figure 1:
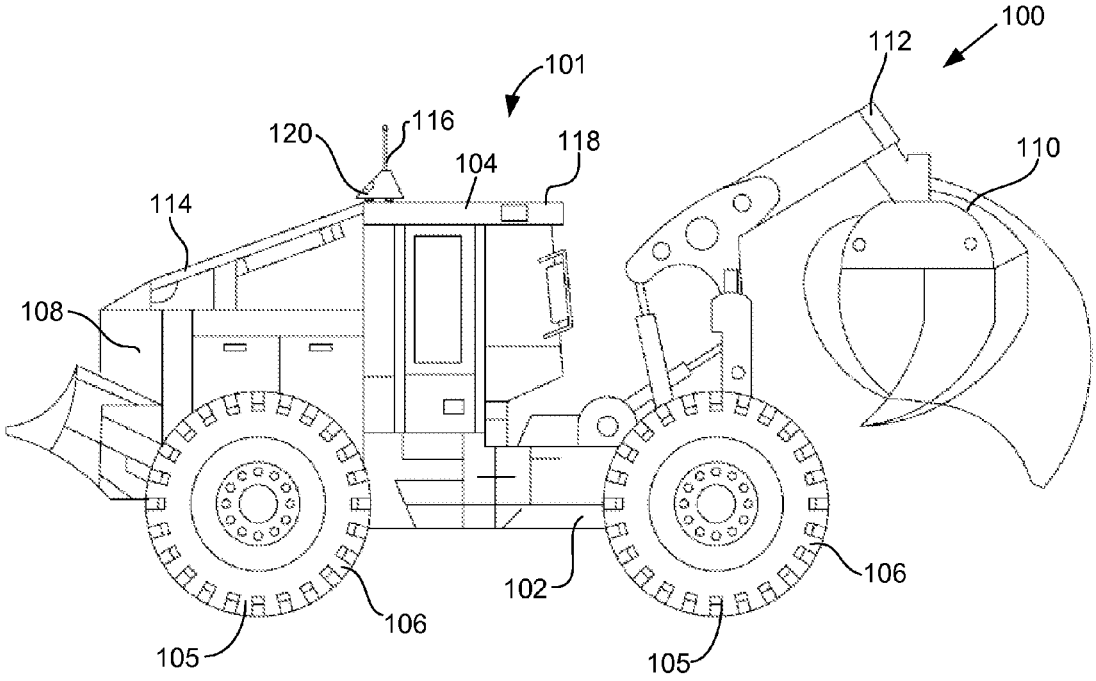
FIG. 1 is a schematic view of a machine having an antenna guard in accordance with the disclosure.

An outline view of a machine 100, in this case a wheel skidder 101, is shown in FIG. 1. The machine 100 includes a frame 102 that may support an operator station 104. The frame 102 may be supported on ground engaging members 105, such as, for example, a set of wheels 106 that may be operatively driven by power generated by an engine (not shown). In the illustrated embodiment, the engine is enclosed in a housing 108 and operates to power at least one of the wheels 106 to move the machine 100. The machine 100 of the illustrated embodiment has a grapple 110 mounted on a hydraulically actuated boom 112 that is used to move logs. Inasmuch as the wheel skidder 101 typically operates in wooded areas, deflector bars 114, such as those illustrated, may be connected between the housing 108 of the engine and the operator station 104 to deflect branches when the wheel skidder 101 is in motion, as well as to protect the housing 108 of the engine from falling tree limbs.

It will be appreciated that positional information may be beneficial to the efficient operation of the machine 100, especially when the machine 100 is operating in remote areas. Accordingly, the machine 100 may be equipped with one or more systems that allow communications between equipment associated with the machine 100 and external equipment such as, for example, a base station (not shown) and/or GPS satellites. Such electronic systems are known, and typically use one or more antennas. An aerial antenna may be utilized in connection with radio communication between the machine and such a base station, while systems that are more sophisticated generally additionally include a satellite antenna for direct and independent acquisition of positional information of the machine using GPS technology. In the illustrated embodiment, the machine 100 includes an aerial antenna 116 that is positioned on a mounting surface 117, here, on the top of a portion 118 of the operator station 104. Other locations on the machine 100 may be used to mount the aerial antenna 116. In an alternate embodiment, for example, the aerial antenna 116 may be mounted on a top surface of the housing 108. In this alternative placement, the aerial antenna 116 may be further protected from large tree limbs by the deflector bars 114.

Positioning of the aerial antenna 116 on a top surface of the machine can provide improved range of operation by increased signal strength of communications between the machine 100 and external sites. The aerial antenna 116 positioned on top of the operator station 104, however, may be prone to damage from passing tree limbs during operation of the machine 100. In order to inhibit damage from environmental causes, the antenna 116 may be provided with a deflector or guard 120. In the illustrated embodiment, a deflector or guard 120 is installed around a base portion of the aerial antenna 116. The guard 120 is arranged to protect the base portion of the aerial antenna 116 from damage and/or excessive bending caused by tree limbs or the like that come into contact therewith, without substantial diminution of the strength of signals communicated to or from the aerial antenna 116.

Turning now to the structure of the embodiment of FIGS. 2-5, the guard 120 has a generally pyramidal shape and forms an opening 202 close to an apex 204 thereof, although the guard may have an alternate shape. Four generally triangular surfaces 208, 210, 212, 214 form an upper body that extends from a generally rectangular base 206 and converge at the apex 204 to define the pyramidal shape. The base 206 of the pyramidal shape is a base opening that is surrounded by four edges. Each of the generally triangular surfaces 208, 210, 212, 214 extends from a widened lower edge proximal the base 206 to a narrowed, upper edge proximal the apex 204. A first or front surface 208 connects a first or front edge 209 of the base 206 with the opening 202 in the apex 204. A second or rear surface 210 connects an opposite or rear edge 211 of the base 206 with a narrowed upper edge proximate the apex 204. The remaining two edges 213, 215 of the base 206 are connected to respective narrowed upper edges proximate the apex 204 via two lateral generally triangular surfaces 212, 214 to complete the pyramidal shape.

Figure 2:
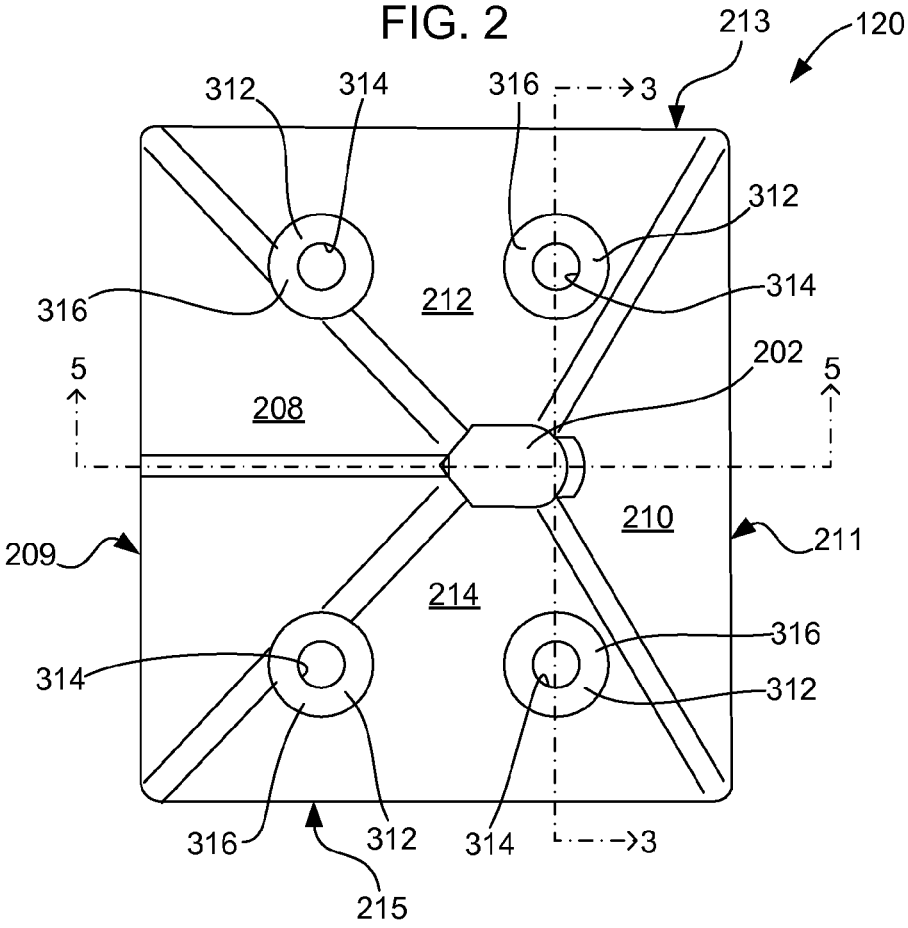
FIG. 2 is a top plan view of a guard in accordance with the disclosure.
Figure 3:
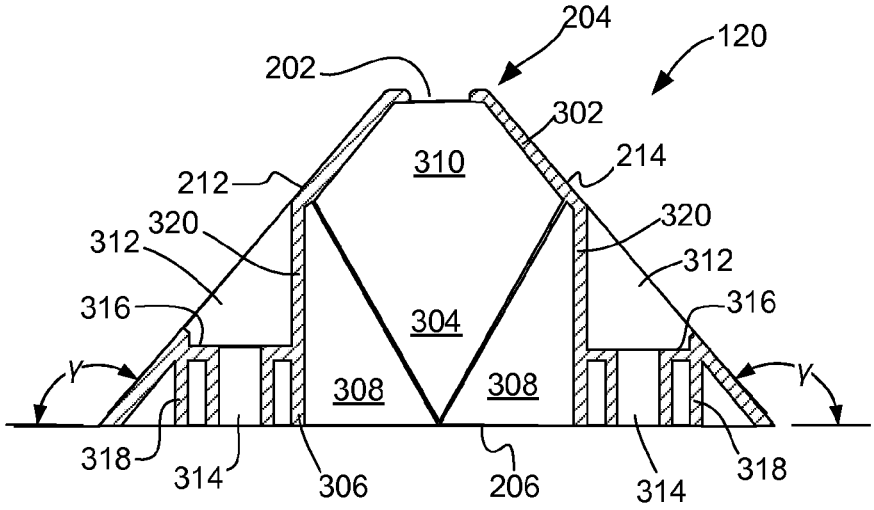
FIG. 3 is a cross-sectional view taken along line 3-3 of the guard in FIG. 2.
Figure 4:
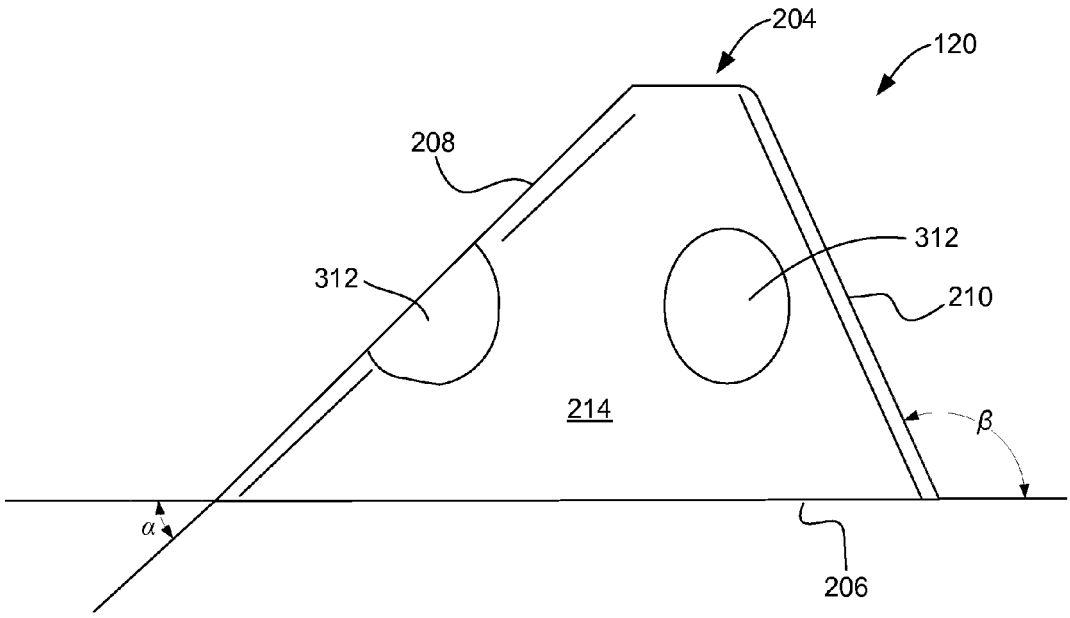
FIG. 4 is a side elevational view of the guard of FIG. 2.
Figure 5:
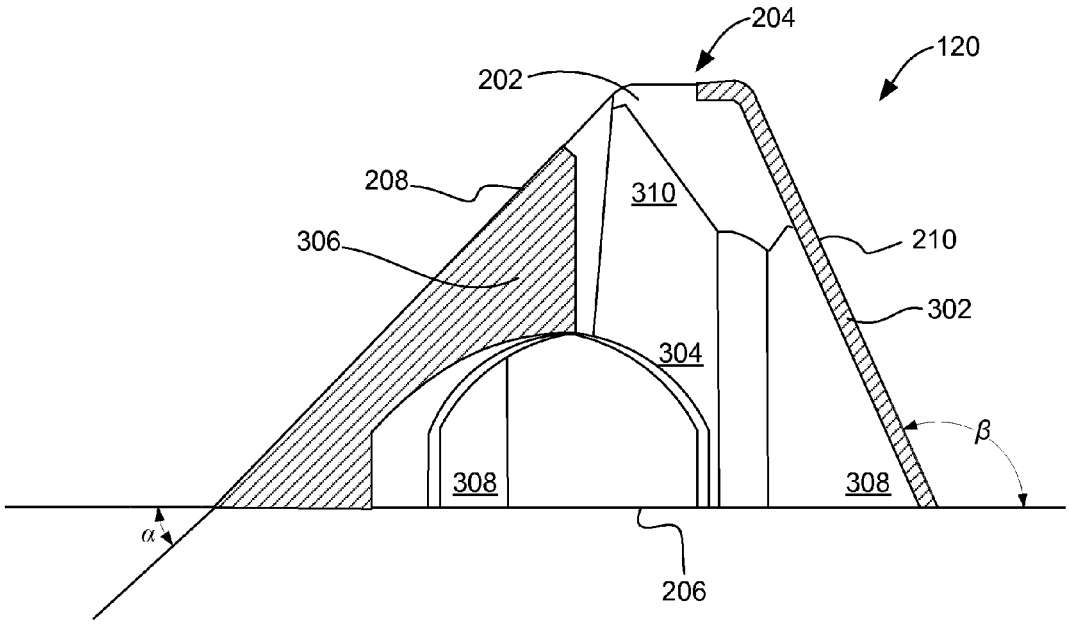
FIG. 5 is another cross-sectional view taken along line 5-5 of the guard in FIG. 2.

While the pyramidal shape of the guard 120 may be symmetrical, the pyramidal shape may alternately be skewed, as may best be seen in FIGS. 2 and 4-5. In other words, the slant height along the bisector, or the distance from the midpoint of two of the four edges 209, 211, 213, 215 of the base 206 from the apex 204, may be different. In the illustrated pyramidal structure, a front angle, $\alpha$, formed between the base 206 and the front surface 208, is more acute than a rear angle, $\beta$, formed between the base 206 and the rear surface 210. The two lateral surfaces 212, 214 may have any respective appropriate slopes. The surfaces 212, 214 may have differing slopes, or, as is best seen by the cross section of FIG. 3, they may have symmetrical slopes, $\gamma$, with respect to the base 206.

The base 206 shown in this embodiment is generally rectangular and planar, as defined by the four edges 209, 211, 213, and 215. One can appreciate that the base of other, alternative embodiments may have a different shape, for example, trapezoidal, elliptical, or any other shape, and may further be non-planar. Aside from accommodating the passage of the aerial antenna 116, the base 206 need not be continuous and can be open, as described in greater detail below.

In the illustrated embodiment, when the guard 120 is installed on the machine 100 (FIG. 1), the guard 120 is oriented such that the first or front surface 208 faces in a direction of travel of the machine 100 and is the first surface likely to initiate contact with a tree limb or other debris that crosses the path of the guard 120. As may best be seen in FIGS. 4 and 5, the first or front surface 208 has a shallow grade that relatively gently lifts the tree limb away from the guard 120, while the second or rear surface 210 having the steeper angle provides support and structural rigidity to the guard 120. For the purposes of this disclosure, the term "grade" will refer to the angle of the identified surface to the mounting surface 117. A shallow grade will indicate a smaller angle, that is, a more narrow structure, while a larger grade will indicate a greater angle, that is, a wider structure. Although the front and rear surfaces may be of any appropriate angles, embodiments may include a front surface 208 disposed at an angle $\alpha$ of less than about 90 degrees, for example, between about 20 and about 80 degrees, such as between about 45 and about 65 degrees, and the rear surface 210 disposed at an angle $\beta$ of more than about 90 degrees, for example, an angle between about 90 and about 135 degrees, such as between about 105 and about 125 degrees, as shown in the figures. In a more particular embodiment, the angle $\alpha$ may be about 55 degrees, and the angle $\beta$ may be about 115 degrees.

Turning now to the cross sections of FIG. 3 and FIG. 5, to accommodate an antenna 116 extending through the guard 120, the guard 120 includes a shell or wall structure 302 that substantially surrounds an internal volume or cavity 304. The cavity 304 is open toward the base 206 and extends through the guard 120 to define the opening 202. The opening 202 is an upper opening, or, an opening in the upper body portion of the guard 120. The cavity 304 may include a base portion 308 extending generally adjacent to the base 206, and a shaft portion 310 extending in a substantially elongate fashion between the base 206 and the opening 202.

To lend rigidity to the wall structure 302 of the guard 120 while reducing the weight and cost of associated material utilized to form the guard 120, the wall structure 302 may include one or more ribs 306 that protrude into the cavity 304. It will be appreciated that the provision of a wall structure 302 that has a relatively uniform thickness, including the respective thicknesses of the ribs 306, may additionally facilitate a more uniform flow and cure of material utilized to fabricate the guard 120.

The guard 120 may be adapted for connection to a machine 100 in any suitable fashion. For example, the guard 120 may include one or more openings for placement of one or more fasteners (not shown). In the illustrated embodiment, the guard 120 includes four fastener openings 312. Each of the four fastener openings 312 includes a through hole or central opening 314 that is surrounded by a flange face 316. Additional strength may be provided to the flange faces 316 by way of ribs which define spacer portions 318 and wall portions 320 surrounding each of the four fastener openings 312. In this embodiment, each spacer portion 318, flange face 316, and wall portion 320, forms a unitary structure that is part of the wall structure 302, such that the guard 120, along with all four fastener openings 312, may be formed as a unitarily-molded component. In use, a fastener is inserted into one or more of the spacer portions 320 and through the through-hole or central opening 314 to couple the guard 120 to the machine 100.

Figure 6:
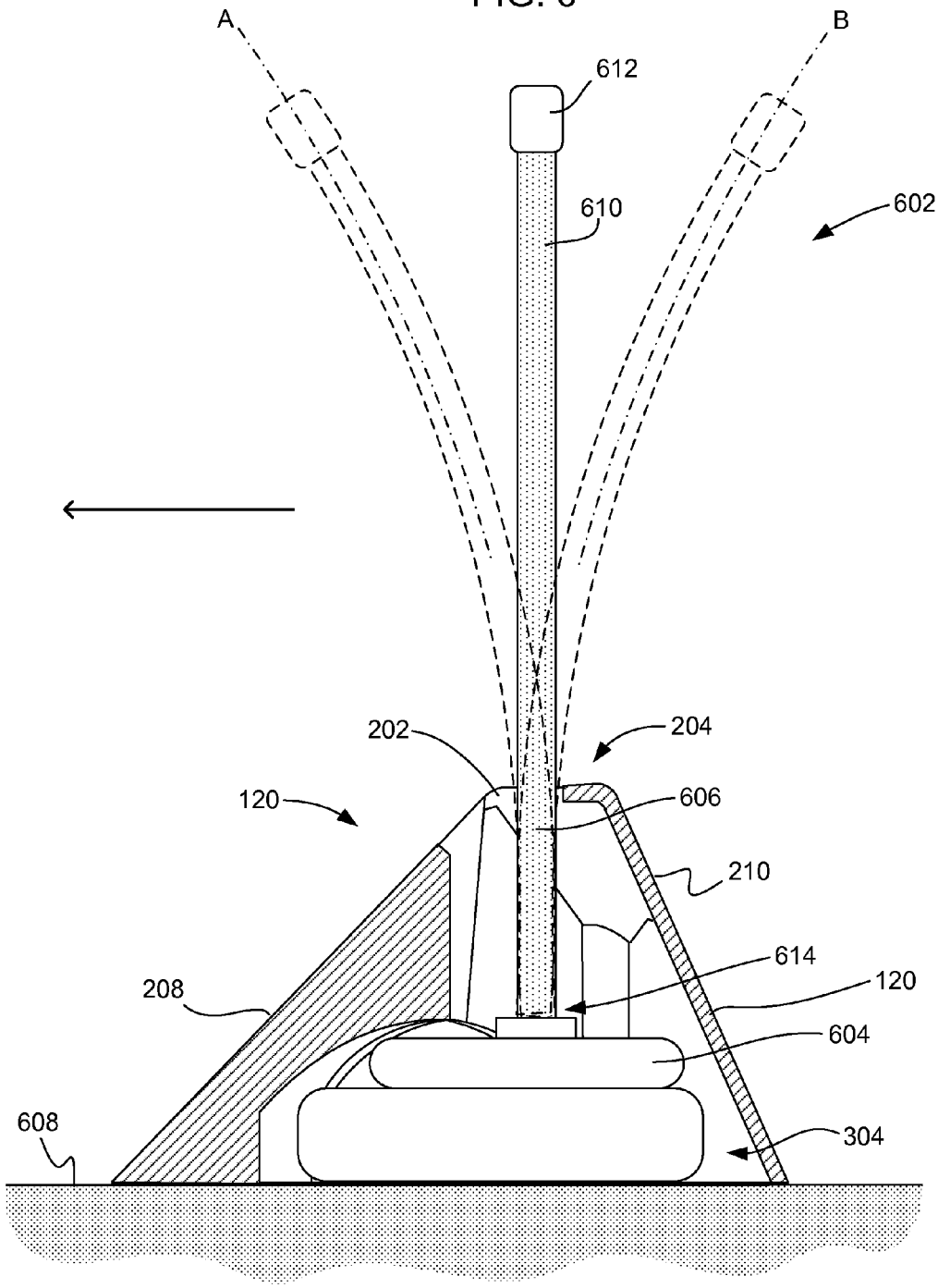
FIG. 6 is a partial cross-sectional view of a guard installed around an antenna assembly in accordance with one embodiment of the disclosure.

A cross-sectional view of the guard 120 as installed over an antenna assembly 602 is shown in FIG. 6. The illustrated antenna assembly 602 is provided by way of example, rather than limitation. The antenna assembly 602 includes an antenna mount or base portion 604 and an aerial portion 606. The base portion 604 may simply be a support structure for mounting the aerial portion 606 to a mounting surface 608, which, for example, may be a surface of a machine such as the machine 100 (FIG. 1). Alternatively, the base portion 604 may be a satellite antenna that is able to communicate with a GPS satellite or other remote unit. The aerial portion 606 may include an antenna shaft 610 and a cap 612.

When the guard 120 is installed around the antenna assembly 602, as shown in FIG. 6, the base portion 604 may be disposed, at least partially, within the cavity 304 of the guard 120. The aerial portion 606 extends out of the guard 120 through the opening 202 formed at the apex 204 thereof. The size of the opening 202 may be sufficiently wide to permit at least some bending of the antenna shaft 610 during operation. Bending of the antenna shaft 610 may be caused, for example, by contact with a passing object or may simply be caused by shaking of the machine. Two bent positions, A and B, are shown in dashed line to illustrate one aspect of the function of the guard 120. As can be seen in the figure, the bending of the antenna shaft 610 may be sufficient to alleviate stresses that may form therein, but is not excessive so that damage might occur in a connection area 614 between the base portion 604 and the antenna shaft 610. The configuration of the guard 120 and the size of the opening 202 may advantageously permit the connection area 614 to remain substantially unaltered even when the end of the antenna shaft 610 that is distal therefrom is at its maximum allowable bending displacement.

Even though the guard 120 surrounds the base portion 604, there may advantageously be little to no degradation of signals travelling to and from the antenna assembly 602 because the guard 120 may be made of a material that does not interfere with or distorts such signals. Hence, even in the case when the base portion 604 includes a satellite antenna, the substantially complete enclosure of the base portion 604 by the guard 120 may not measurably degrade the performance of the satellite antenna in the base portion 604, because signals may enter the cavity 304 substantially unaffected by the material of the guard 120. Moreover, even in the case of signals reaching or being transmitted by the aerial portion 606, the signal strength will not be measurably reduced by the enclosure of at least a portion of the antenna shaft 610 within the cavity 304 because of the low signal reactivity of the material making up the guard 120.

Figure 7:
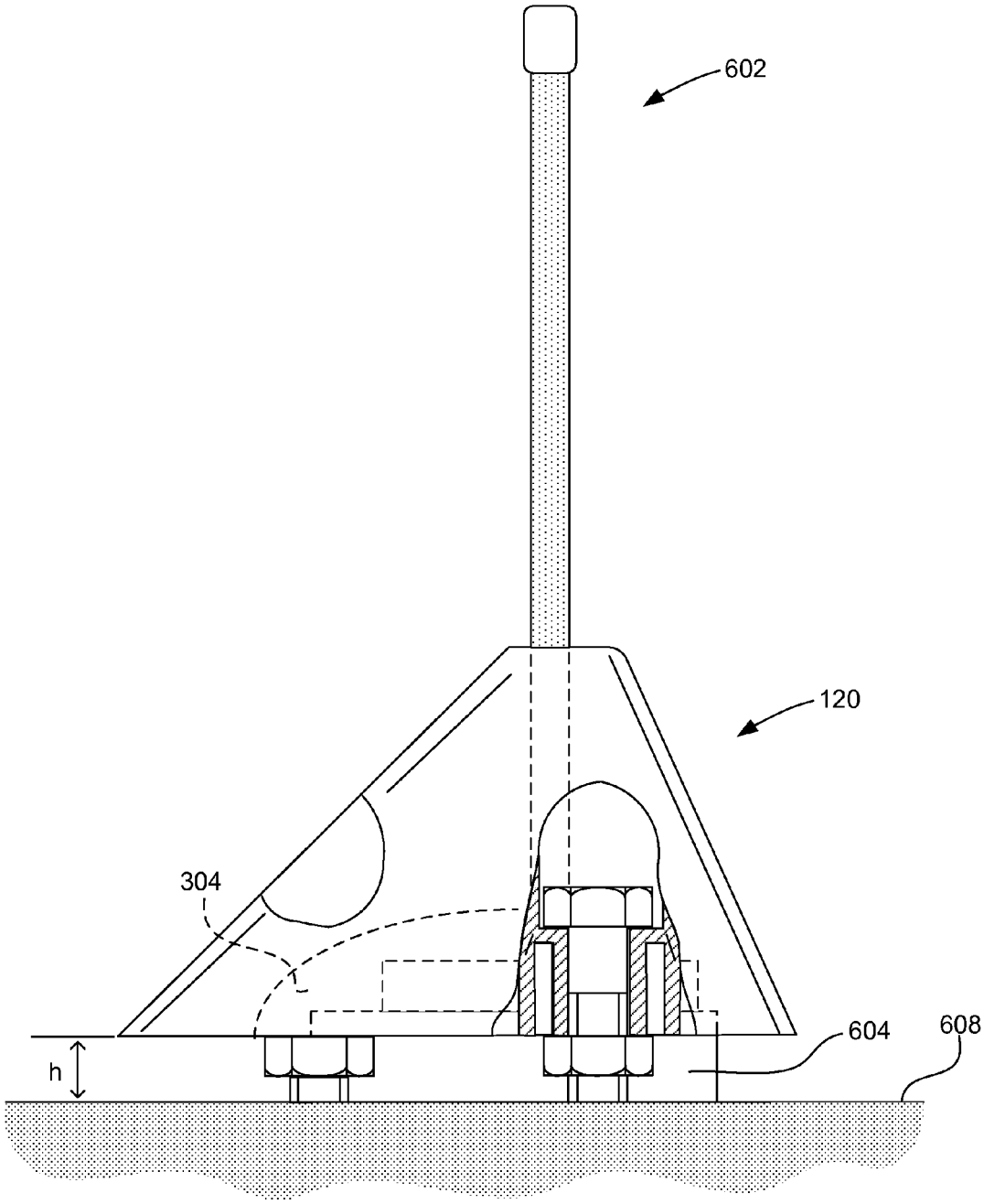
FIG. 7 is a partially broken away, side elevational view of a guard installed around an antenna assembly in accordance with an alternative embodiment of the disclosure.
Figure 8:
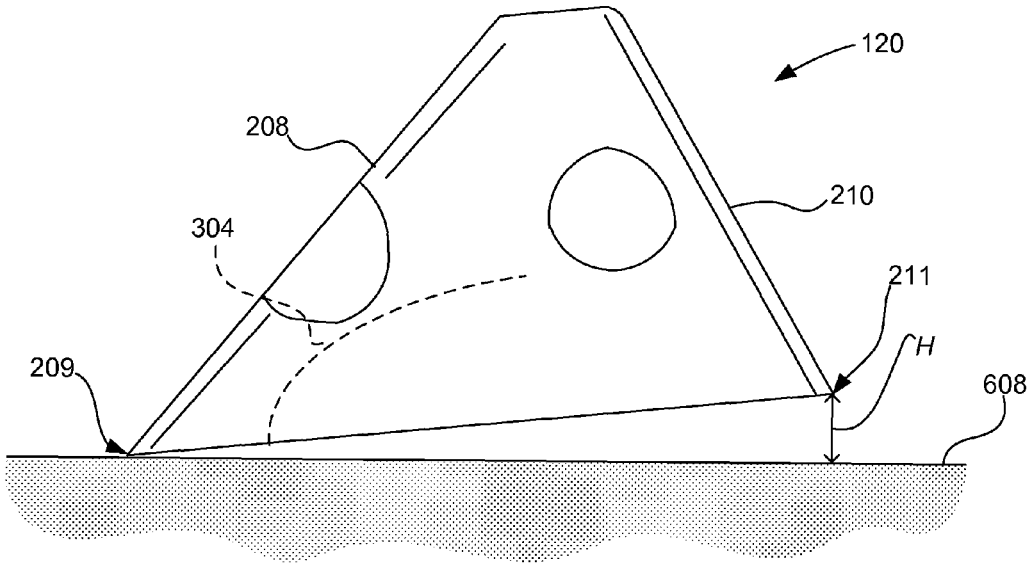
FIG. 8 is a side elevational view of an alternate embodiment of a guard installed on a machine in accordance with the disclosure.

As one can appreciate, the mounting arrangement shown in FIG. 6 may perform well in protectively surrounding the base portion 604 of the antenna assembly 602, but may, under certain conditions, also allow water, ice, or loose debris from the environment to enter the opening 202 and collect within the cavity 304 and at least partially surround the base portion 604. Such accumulations may cause damage to the antenna assembly 602 and may further interfere with signal communications. Accordingly, an alternate mounting arrangement for the guard 120 around the antenna assembly 602 is shown in FIG. 7. In this embodiment, the guard may be installed at a height, h, relative to the mounting surface 608 that is sufficient to allow water or debris to pass through the cavity 304 and exit from the bottom of the guard 120. In this way, the base portion 604 may still be sufficiently surrounded and protected, while the gap between the base portion 604 and the mounting surface 608, measured by the height h, may serve to purge or to discourage accumulation of water or debris within the cavity 304 of the guard 120.

It will be appreciated that the height h may be any distance adequate to allow some or all water or debris entering the opening 202 to pass through the cavity 304, while still affording a desired degree of protection to the antenna assembly 602. The greater the height h and extent of passage may, potentially, result in a decreased level of protection afforded to the antenna assembly 602. In an embodiment, the height h may be on the order of about 15 mm or, generally, anywhere within the range of about 5 mm to about 30 mm.

Figure 9:
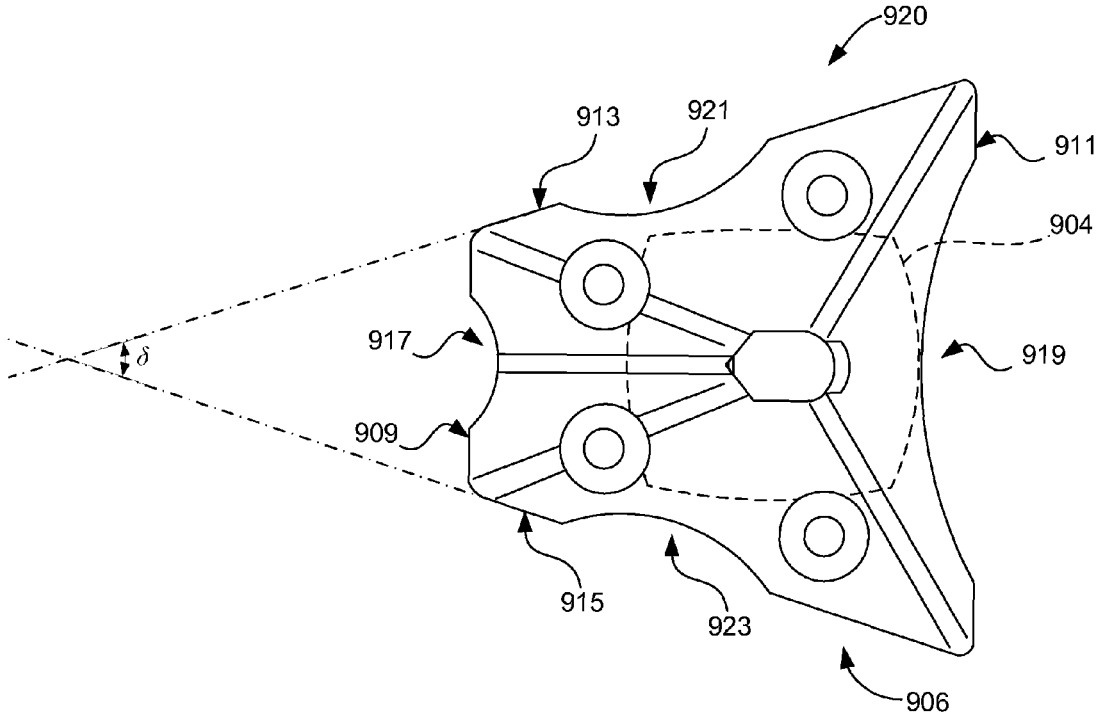
FIG. 9 is a top plan view of a guard in accordance with an alternate embodiment of the disclosure.

Moreover, while the guard 120 is illustrated at a uniform height h from the mounting surface 608, it will be appreciated that the height h need not necessarily be uniform, or the guard 120 may include an uneven lower surface. For example, an alternate embodiment for installation of the guard 120 is shown in FIG. 9. In this depiction, the guard 120 may be mounted such that it cants forward, the edge 209 of the front surface 208 resting on the mounting surface 608 of the machine 100, and the edge 211 of the rear surface 210 being at a height, H, relative to the mounting surface 608. In this alternate embodiment, any water or debris may be free to exit from the cavity 304 through the space between the base 206 and the mounting surface 608 without compromising the protection of the antenna in the direction of travel of the machine. Alternately, the guard 120 may further include an extended front wall such that the front surface 208 extends below the base 206 of the guard 120. In both such arrangements, the abutment of the lower edge 209 of the front surface 208 with the mounting surface 608 may provide further protection of the antenna assembly 602 from debris impacting upon the guard 120 during machine transport and usage.

Another example of an alternate embodiment of a guard 920 is shown in the top plan view of FIG. 9. In this embodiment, the base 906 of the guard 920 has a trapezoidal rather than a rectangular shape. The base 906 is defined between a front or first edge 909, a rear edge 911, which is parallel to the first edge 909, and two lateral edges 913 and 915 that are disposed at an angle, $\alpha$, relative to one another. In this embodiment, the base 906 may rest onto and be generally parallel with a mounting surface of the machine, but include openings or concave sections formed along the edges 909, 911, 913, and 915 thereof to provide for drainage and evacuation of water and debris from within the cavity 904 of the guard 920. Each of the edges 909, 911, 913, and 915 may form, respectively, a drainage opening 917, 919, 921, and 923, with each being in communication with a respective portion of the cavity 904. One can appreciate that such and other features may be combined in any of the embodiments for a guard that are described herein.

INDUSTRIAL APPLICABILITY

The present disclosure is applicable to vehicles or machines that have antennas installed on external surfaces thereof. The present disclosure is especially applicable in situations where antennas may become damaged by coming into contact with external objects. If repositioning or otherwise limiting the antenna's exposure to external objects is not practical, the antenna guard disclosed herein is well suited to protect the antenna. The guard may be adapted for protection of various types of antennas, for example, aerial, satellite, or other types, from impacts or contact with external objects, such as branches of trees.

The antenna guard as disclosed herein may be made of a material that does not substantially interfere with or degrade the signals reaching or being transmitted by the antenna. The guard may be fabricated from any appropriate material. For example, it may be formed of a material that is resilient enough to withstand impacts, and/or a material that is sufficiently conductive so as not to interfere with or cause a diminution of signal strength. The material may be chosen to provide or may contain additives that may improve characteristics such as resistance to weathering, impact resistance, strength and rigidity, resilience, low dielectric interference properties, and/or other desirable attributes. By way of example only, ultraviolet (UV) stabilizers such as, for example, black pigmentation, may improve resistance to degradation from exposure to the sunlight. Moreover, the materials may be chosen to provide acceptable aesthetic surfaces without the need of secondary painting operations. While the material may be any suitable metallic, ceramic, polymeric, or composite material, one example of a suitable material for the guard is a Polycarbonate/Polyester blend, such as Polycarbonate/Polybutylene Terephthalate (PC/PBT), in an unfilled composition, although the material may alternately be filled.

The guard may likewise be fabricated by any appropriate method as a unitary piece or in separate subassemblies that are subsequently joined to form the finished guard. By way of example only, the guard or its subassemblies may be injection molded, transfer molded, extruded, pressed, die cut, welded, glued, machined, or otherwise fabricated or formed using any known method. If the guard is formed of separate subassemblies, the subassemblies may be joined by any appropriate method, such as, by way of example only, adhesive, fastener (s), and sonic welding.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A guard for an antenna assembly installed on a machine, the machine having a mounting surface, the guard being adapted for mounting on the mounting surface, the guard comprising:

a base defined between a front edge, a rear edge, and two lateral edges, wherein the front edge is disposed opposite the rear edge;

a front generally triangular surface having a narrowed upper edge, the front surface extending from the front edge of the base to the narrowed upper edge of the front surface;

a rear generally triangular surface having a narrowed upper edge, the rear surface extending from the rear edge of the base to the narrowed upper edge of the rear surface;

two lateral generally triangular surfaces, each having a narrowed upper edge, the lateral surfaces extending from the respective lateral edge to the narrowed upper edge of the respective lateral surface;

the narrowed upper edges of the front surface, the rear surface, and the two lateral surfaces forming an apex, the apex forming an opening;

the front surface, the rear surface, and the two lateral surfaces at least partially defining an internal cavity;

the front surface being disposed at a first angle relative to the mounting surface and the rear surface being disposed at a second angle relative to the mounting surface, the first angle being smaller than the second angle; and the guard being adapted to enclose at least a portion of the antenna assembly within the internal cavity.

2. The guard of claim 1, wherein the front surface, the rear surface, and the two lateral surfaces are arranged to form a generally pyramidal shape for the guard.

3. The guard of claim 1, wherein the two lateral surfaces have symmetrical slopes with respect to the base.

4. The guard of claim 1, wherein the front edge, the rear edge, and the two lateral edges define a rectangular and planar shape for the base.

5. The guard of claim 1, wherein the cavity is open toward the base and extends through the guard to form the opening at the apex.

6. The guard of claim 1, wherein the guard further includes at least one fastener opening that includes:

a central opening adapted to accommodate a fastener;

a flange face surrounding the central opening; and a spacer portion connecting an outer portion of the flange face with at least one of the front surface, the rear surface, and one of the two lateral surfaces;

such that the flange face, the spacer portion, and the at least one of the front surface, the rear surface, and one of the two lateral surfaces forms a unitary structure.

7. The guard of claim 1, wherein the guard is made of a Polycarbonate/Polyester blend.

8. The guard of claim 7, wherein the Polycarbonate/Polyester blend is Polycarbonate/Polybutylene Terephthalate (PC/PBT) in an unfilled composition that contains ultraviolet (UV) stabilizers.

9. The guard of claim 1, wherein the two lateral edges are disposed at an angle relative to one another to define a trapezoidal base.

10. The guard of claim 1, wherein at least one of the front edge, the rear edge, and each of the two lateral edges forms a drainage opening that communicates with the cavity.

11. A guard for use with an antenna installed on a mounting surface of a machine adapted to travel in a direction, the antenna including an antenna mount connected to the mounting surface and an aerial portion connected to the antenna mount and extending away from the mounting surface, the guard comprising:

a skewed pyramidal shape having a base having a base opening therethrough, and an upper body, the upper body having at least a front surface and a rear surface extending from the base, the front surface being disposed at a shallower grade than the rear surface, the front surface adapted to be disposed facing the direction of travel of the machine;

two lateral surfaces oppositely disposed between the front surface and the rear surface, wherein the two lateral surfaces have substantially symmetrical slopes with respect to the mounting surface;

the upper body defining an upper opening, the aerial portion extending through the upper opening, the antenna mount extending through the base opening;

wherein at least one drainage opening is formed by at least one of the front surface, the rear surface, and each of the two lateral surfaces, the at least one drainage opening extending between the mounting surface and the guard in use to provide a passage for water and debris within the guard to exit the guard through the at least one drainage opening.

12. The guard of claim 11, wherein the guard further includes a cavity formed internally to the guard and the upper body includes an apex, the upper opening being disposed substantially adjacent to the apex, the cavity being in communication with the upper opening and the base opening, the antenna mount being disposed within the cavity and the aerial portion extending out of the guard through the upper opening in use.

13. The guard of claim 11, wherein the guard is made of a Polycarbonate/Polyester blend.

14. The guard of claim 13, wherein the Polycarbonate/Polyester blend is Polycarbonate/Polybutylene Terephthalate (PC/PBT) in an unfilled composition that contains ultraviolet (UV) stabilizers.

15. The guard of claim 11, wherein the skewed pyramidal shape of the guard defines the base, and wherein the base has at least one of a substantially rectangular shape and a substantially trapezoidal shape.

* * * * *

UNITED STATES PATENT AND TRADEMARK OFFICE

CERTIFICATE OF CORRECTION

PATENT NO. : 8,085,207 B2
APPLICATION NO. : 12/186355
DATED : December 27, 2011
INVENTOR(S) : Miller et al.

It is certified that error appears in the above-identified patent and that said Letters Patent is hereby corrected as shown below:

In the Specification

Please correct the following as follows:

Column 6, line 65, delete "angle, α," and insert -- angle, δ, --.

Signed and Sealed this
Fourteenth Day of July, 2015

Michelle K. Lee

Michelle K. Lee
*Director of the United States Patent and Trademark Office*